US005271125A

United States Patent [19]

Leifeld et al.

[11] Patent Number: 5,271,125

[45] Date of Patent: Dec. 21, 1993

[54] SLIDEWAY FOR TRAVELLING FLATS IN A CARDING MACHINE

[75] Inventors: Ferdinand Leifeld, Kempen; Paul G. Teichmann, Mönchengladbach, both of Fed. Rep. of Germany

[73] Assignee: Trützschler GmbH & Co. KG, Mönchengladbach, Fed. Rep. of Germany

[21] Appl. No.: 854,066

[22] Filed: Mar. 19, 1992

[30] Foreign Application Priority Data

Mar. 19, 1991 [DE] Fed. Rep. of Germany ..... 4108921

[51] Int. Cl.[5] ..... D01G 15/02

[52] U.S. Cl. ..... 19/103

[58] Field of Search ..... 19/102, 103, 111, 110, 19/113, 112

[56] References Cited

U.S. PATENT DOCUMENTS 361,815 4/1887 Dobson et al. ..... 19/103
4,991,262 2/1991 Brun et al. ..... 19/102

FOREIGN PATENT DOCUMENTS 0144184 6/1985 European Pat. Off. .
565218 11/1932 Fed. Rep. of Germany .
609287 2/1935 Fed. Rep. of Germany .
7345579 3/1974 Fed. Rep. of Germany .
3907396 3/1990 Fed. Rep. of Germany .
590280 7/1947 United Kingdom .
2224043 4/1990 United Kingdom .

*Primary Examiner*—Clifford D. Crowder
*Assistant Examiner*—Michael A. Neas
*Attorney, Agent, or Firm*—Spencer, Frank & Schneider

[57] ABSTRACT

A carding machine includes a main carding cylinder; a lateral support component situated laterally of the main carding cylinder; and a travelling flats assembly situated above the main carding cylinder and having a working path along an upper circumference. The travelling flats assembly has a first and a second end sprocket positioned at a beginning and at an end, respectively, of the working path; an endless drive element supported by the end sprockets; a slideway having a convex portion following the curvature of the main carding cylinder and a concave portion adjacent the convex portion and following the curvature of the first and second end sprockets, respectively; a fastening device for securing the slideway to the lateral component; and a plurality of flat bars carried by the endless drive element; each flat bar has a flat bar end supported on the slideway.

20 Claims, 4 Drawing Sheets 1
2
3
4
5
6
7
8
9
10
11
12
13
14
15a
15b
16
17a
17b
17c
19
40
41
A
B
C
D
E
a
b
c Fig. 4
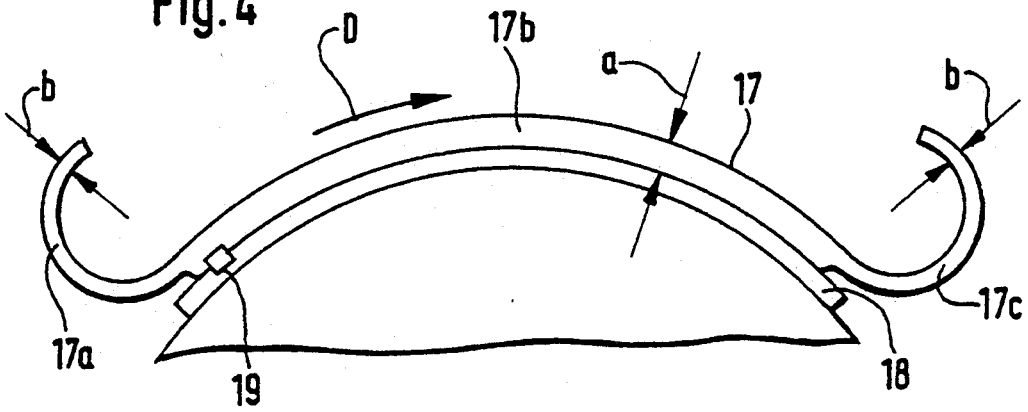
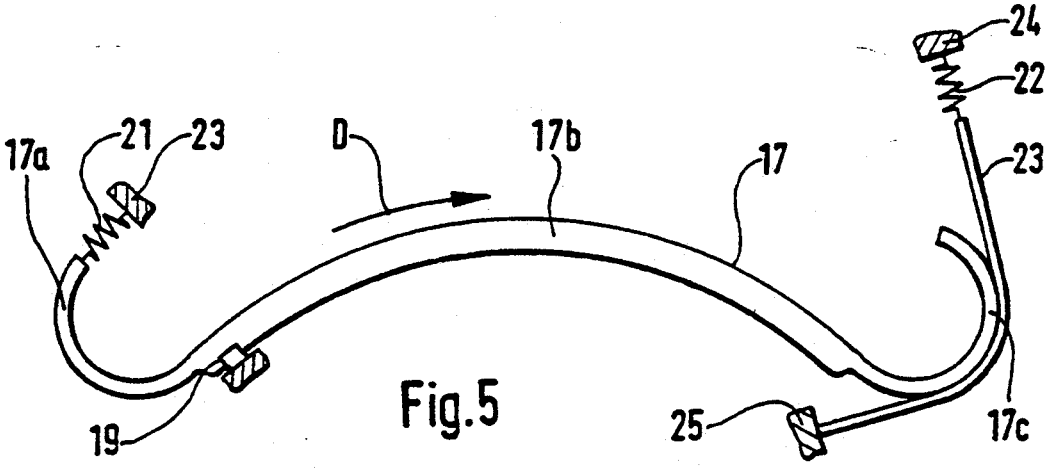
Fig. 5

Fig.6
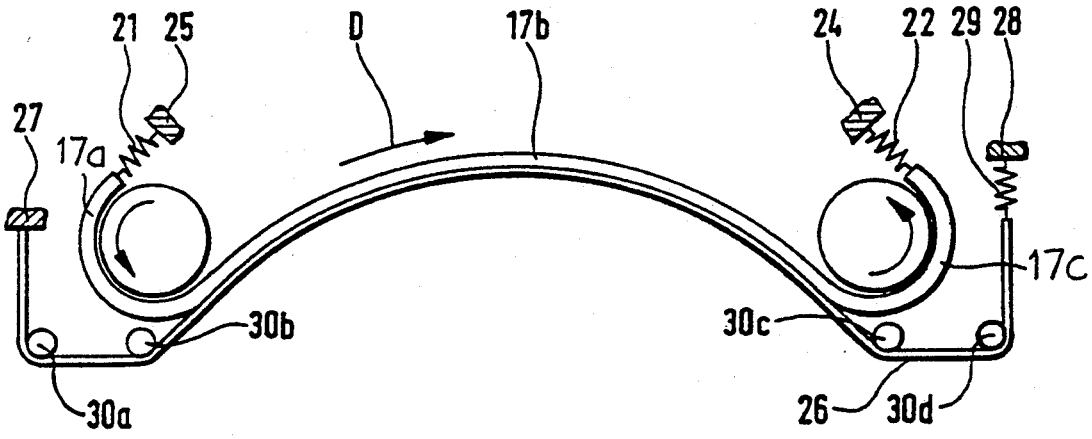
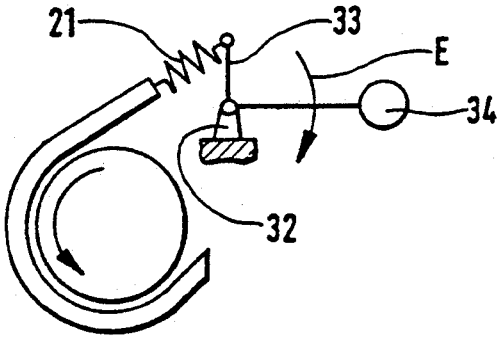
Fig.6a
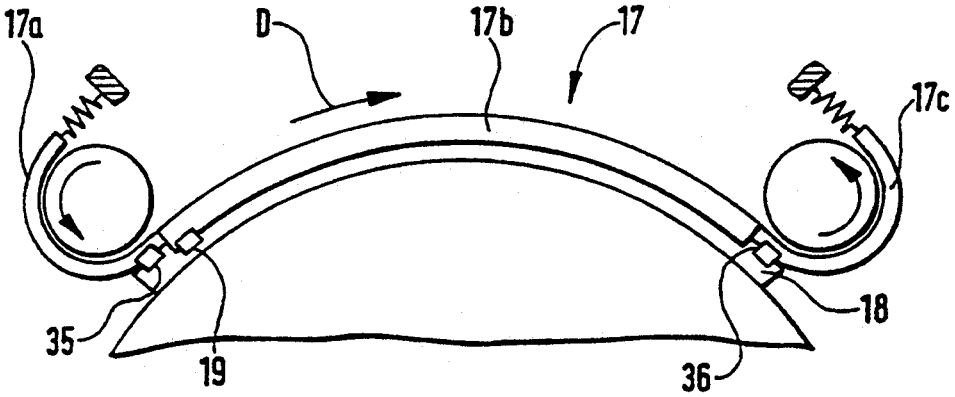
Fig.7

SLIDEWAY FOR TRAVELLING FLATS IN A CARDING MACHINE

CROSS REFERENCE TO RELATED APPLICATION

This application claims the priority of German Application No 41 08 921.9 filed Mar. 19, 1991.

BACKGROUND OF THE INVENTION

The invention relates to a slideway for guiding clothed travelling flats in a carding machine. The travelling flats are advanced by means of at least one endless drive element such as a flexible belt. Opposite ends of each flat bar glide in a slideway along the work path of the flats, and after having reached the end of the work path, the flat bars ar carried back to the beginning of the work path by the endless driving element on the side opposite the slideways. The slideways have a central zone (hereafter also termed as "convex" zone) closely following the curvature of the main carding cylinder at the top portion thereof and two end zones (hereafter also termed as "concave" zones) which closely follow the curvature of the end sprockets of the travelling flats.

Conventionally, the slideway in which the flat bar ends slide is a one-piece plastic component which at one end is immobilized by a securing device at a location where the flat bars enter the slideway. At the end of the concave slideway portion a holding element is secured which clamps, with a clamping element, an end of the slideway by means of a screw-and-nut connection. The flat bars exert a pulling force on the slideway, whereby the concave slideway zones are likely to exert an excessive radial looping pressure on the flats which may lead to a wear of the slideway, to scores or the like. Further, loads as well as high temperatures or temperature variations may cause a plastic deformation of the slideway material which may lead to a faulty guidance of the flat bars in the concave inlet slideway zone.

SUMMARY OF THE INVENTION

It is an object of the invention to provide an improved slideway support from which the above-discussed disadvantages are eliminated and which, in particular, ensures a low wear of the slideway and a disturbance-free flat bar guidance during operation.

This object and others to become apparent as the specification progresses, are accomplished by the invention, according to which, briefly stated, each slideway is secured at a location to a lateral support element (for example, the card arch) of the carding machine.

By securing the slideway to a lateral support element, particularly to the flexible bend of the carding machine, interfering tension forces and thus undesired radial pressures on the slideway in the concave inlet slideway zone are avoided. In this manner, the entire tension force of the flat bars in the running direction is no longer converted into a circumferential, radially inwardly-directed pressure, so that undesired wear is effectively avoided. It is sufficient to provide the securement at a sole location, particularly at the beginning of the work path of the flats, in a transitional zone between the concave and convex zones of the slideway, in order to avoid undesired tension forces.

It is a particular advantage of the inventive measures that a clearance or air gap between the flat bars on the one hand and the slideway on the other hand is avoided. In case of a rigid slideway such a clearance or air gap cannot be eliminated and can lead to misalignments during run which promptly lead to wear. In case the slideway is rigid and tight, material is being shaved off until again air is present. Then, to the wear caused by the tight run there have to be added misalignments which lead to breaks in the synthetic material and an abrasion of the flats material. The continuous engagement by looping causes a shearing effect which pushes dirt from the track and thus such dirt has a greater difficulty to gain access to and settle between the flat bar and the plastic slideway guide.

BRIEF DESCRIPTION OF THE DRAWING

FIG. 4 is a side elevational view of a one-part slideway according to a preferred embodiment of the invention having a relatively thick-walled convex zone and a relatively thin-walled concave zone.

FIG. 5 is a side elevational view similar to FIG. 4, showing a slideway securing device according to a further preferred embodiment of the invention.

FIG. 6 is a side elevational view of a further preferred embodiment of the invention, including an externally positioned support band.

FIG. **6*a*** is a side elevational view of still another preferred embodiment of the invention showing weight application to a free end of the slideway.

FIG. 7 is a schematic side elevational view of a slideway formed of independent slideway zones according to yet another preferred embodiment of the invention.

DESCRIPTION OF THE PREFERRED EMBODIMENTS

Figure 1:
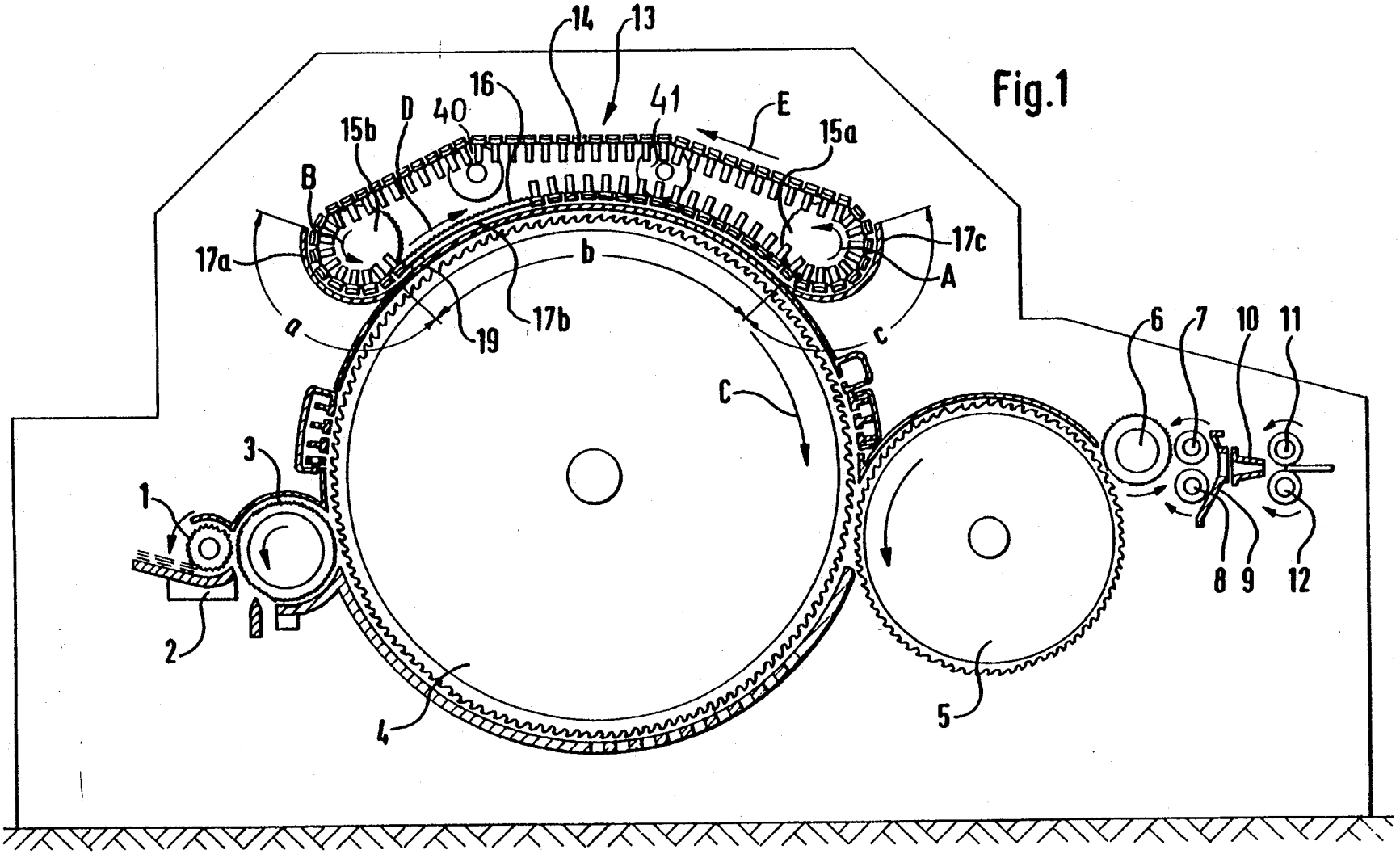
FIG. 1 is a schematic side elevational view of carding machine including travelling flats, incorporating the invention.

Turning to FIG. 1, there is illustrated therein a carding machine which may be, for example, an EXACTA-CARD model, manufactured by Trützschler GmbH & Co. KG, Mönchengladbach, Germany. The carding machine has a feed roll 1 and a feed table 2 cooperating therewith, a licker-in 3, a main carding cylinder 4, a doffer 5, a stripping roll 6, crushing rolls 7 and 8, a fiber web guiding element 9, a sliver trumpet 10, calender rolls 1 and 12 as well as travelling flats 13. The direction of rotation of the front and rear flat supporting end rolls **15*a* and 15*b* which are tooth belt sprockets, indicated by respective arrows A and B, is opposite the direction of rotation of the main carding cylinder 4, as indicated by the arrow C. The flat bars 14 are advanced in the direction of the arrow D along a working path in a slideway 17 by a toothed belt 16. The beginning of the working path is situated adjacent the end sprocket 15*b*, whereas the end of the working path is located adjacent the end sprocket 15*a*. The flat bars 14 are advanced in the reverse direction E on the upper side of the travelling flats 13, opposite the slideway 17. The slideway 17** may be made of ZX 100 plastic which has approximately 80% polyester and has a high strength, small expansion, small propensity for plastic deformation, good dry friction properties and is furthermore wear resistant.

Figure 2:
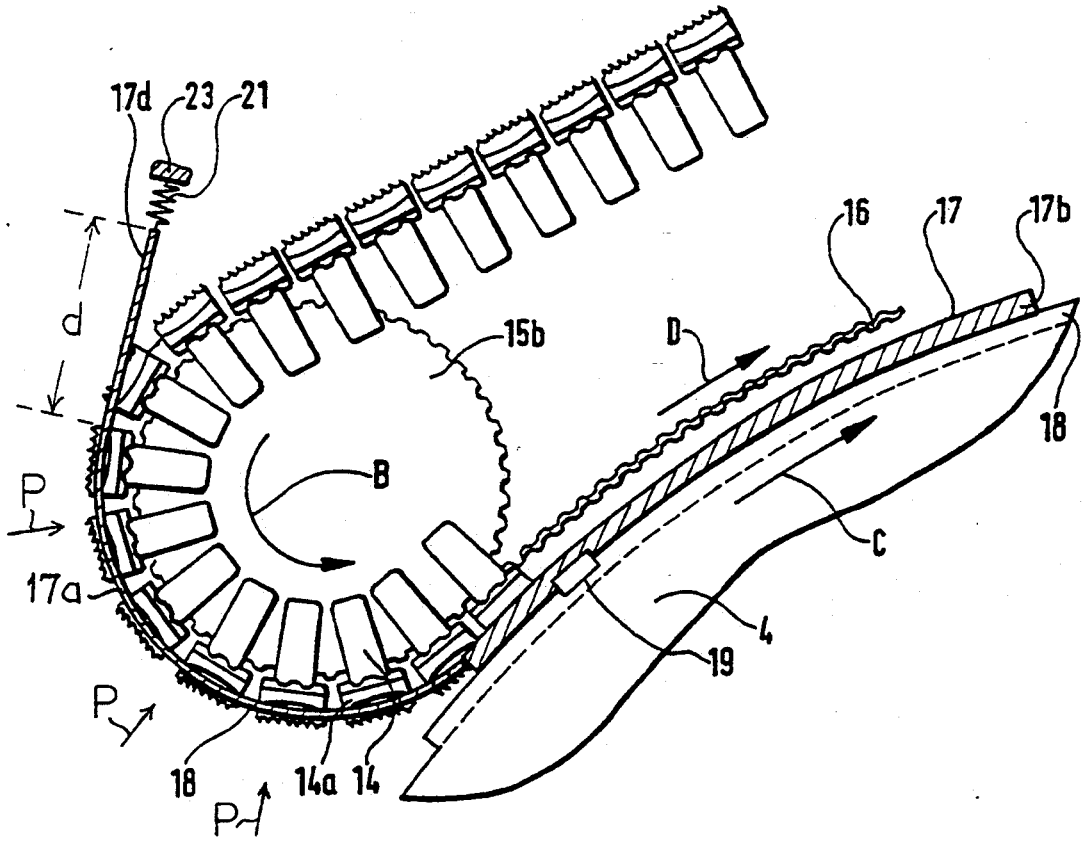
FIG. 2 is a fragmentary enlarged side elevational detail of the travelling flats shown in FIG. 1, illustrating a preferred embodiment.

FIG. 2 illustrates in more detail the travelling flats shown in FIG. 1. The flat bars 14 engage the slideway 17 with the underside of the bar ends 14*a*. The teeth of the sprocket 15*b* engage the teeth on the inside of the toothed belt 16 and advance the lower flight of the belt 16 in the forward direction as indicated by the arrow D. Similarly, the sprocket 15*a* engages with its teeth the inside of the toothed belt 16 and advances the upper flight of the belt 16 in the direction of the arrow E. The outside of the toothed belt 16 is form-fittingly connected with that side of each bar end 14*a* that is remote from the clothing of the flat bar. The belt 16 presses the bar ends 14*a* onto a convex length portion 17*b* of the slideway 17. The convex portion 17*b* follows the curvature of the main carding cylinder 4. Also referring to FIG. 4, the opposite ends of the convex portion 17*b* are adjoined by concave slideway portions 17*a* and 17*c* which follow the curvature of the respective end sprockets 15*b* and 15*a* and which maintain the flat bars 14 in position in the course of their circular travel about the periphery of the end sprockets 15*a* and 15*b*. The concave slideway portions 17*a* and 17*c* may be plastic-coated steel bands. During return travel in the direction of the arrow E, the flat bar ends 14*a* lie loosely on the outer side of the upper reach of the belt 16. The upper reach is backed by two support rollers 40 and 41 shown in FIG. 1. The lower reach of the belt 16 and the carding cylinder 4 travel in the same direction (arrows C and D).

The slideway is arranged on the card arch 18 and is, at the location 19 which is in the zone of the convex portion 17*b* adjacent the end sprocket 15*b*, secured to the flexible bend 18 by a fastening device such as a clamping device or a metal/plastic connection or the like.

The concave portion 17*a* of the slideway 17 has a linear terminal part 17*d* of a length d. To the end of the terminal part 17*d* there is attached one end of a tension spring 21 which, at its other end, is secured to a stationary support 23. The spring 21 has soft spring characteristics to avoid a strong pressure by the concave portion 17*a* in a radially inward direction. As seen in FIG. 6, at the concave portion 17*c*, at the sprocket 15*a*, a similar spring arrangement is provided.

Figure 3:
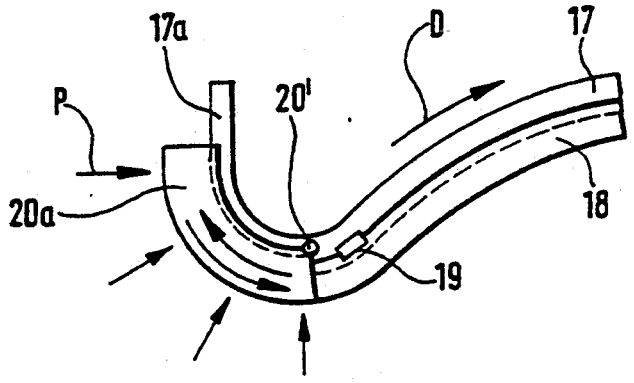
FIG. 3 is a side elevational view of the inlet end of a slideway with supporting element according to the invention.

Turning to FIG. 3, on the outside of the concave portion 17*a* (as well as the non-illustrated concave portion 17*c*) there is provided a concavely bent support element 20*a* whose one end is pivoted to the slideway 17 at 20' so that the pressure of the concave portions 17*a* in the radial direction (as shown by the arrows P) may be adjusted relative to the respective end sprocket 15*a* or 15*b*.

Turning to FIG. 4, there is shown therein a one-piece slideway 17 having a relatively thick-walled convex portion 17*b* having a thickness a which resists expansion and two relatively thin-walled concave portions 17*a* and 17*c* which have a thickness b and which are flexible.

Turning to FIG. 5, the concave portion 17*c* is at its outer side in a shape-conforming engagement with a bent support band 23 made, for example, of steel, whose one end is held in a stationary support 25 while its other end is attached to a fixedly held tension spring 22. Thus, a portion of the band 23 is coaxially looped around the concave portion 17*c*. By virtue of this arrangement, the radial pressing effect of the concave portion 17*c* may be adjusted.

In FIG. 6, a support band 26 engages the underside of the convex portion 17*b* of the slideway 17 The support band 26 is trained about rollers 30*a*, 30*b*, 30*c* and 30*d* and one of its ends is secured to a stationary support 27 whereas its other end is attached to a tension spring 29 attached to a fixed support 28. According to FIG. 6*a*, the spring 21 secured to the end of the concave portion 17*a* is attached to one end of a bellcrank 33 which is pivotally held in a stationary support 32. To the other end of the bellcrank 33 a weight 34 is attached, whereby the bellcrank 33 is urged to rotate about pivot 32 in the direction of the arrow E.

As shown in FIG. 7, the three slideway portions 17*a*, 17*b* and 17*c* of the slideway 17 are separate components. The concave parts 17*a* and 17*c* are secured to the flexible bend 18 at locations of attachment 35 and 36, respectively.

Thus, according to the invention, by virtue of the soft-spring arrangements, the concave portions 17*a* and 17*c* of the slideway 17 exert only a slight resilient pressure in a radially inward direction and consequently, disadvantageously high loop-around pressures are avoided.

It is to be understood that the securing device which was shown and described as being provided on one side of the card may be duplicated on the other side thereof. An arrangement is feasible wherein the working travel of the flats 14 is opposite to the rotary direction of the carding cylinder 4. In such an arrangement the securement 19 is expediently provided adjacent the sprocket 15*a*.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder;

(b) a flexible bend situated laterally of said main carding cylinder; and (c) a travelling flats assembly situated above said main carding cylinder and having a working path along an upper circumference of said main carding cylinder; said travelling flats assembly including (1) a first and a second end sprocket positioned at a beginning and at an end, respectively, of said working path;

(2) an endless drive element trained about and supported by said first and second end sprockets;

(3) a slideway positioned on said flexible bend; said slideway having a convex portion following the curvature of said main carding cylinder along said working path and a concave portion adjacent said convex portion at the beginning and at the end, respectively, of said working path; said concave portions following the curvature of said first and second end sprockets, respectively;

(4) support means for holding said concave portions about said first and second end sprockets, respectively;

(5) a plurality of flat bars carried by said endless drive element, each flat bar having a flat bar end supported on said slideway for travel along said working path; and (6) fastening means for fixedly securing said slideway to said flexible bend at a location of attachment; said location of attachment being situated in said convex portion of said slideway.

2. A carding machine as defined in claim 1, wherein said slideway has a free, linear terminal length adjoining each said concave portion and being tangential thereto.

3. A carding machine as defined in claim 1, wherein said location of attachment is situated in a zone of said first end sprocket.

4. A carding machine as defined in claim 1, wherein said support means including means for exerting a slight, radially inwardly directed pressure on said concave portions.

5. A carding machine as defined in claim 1, wherein said concave portions are thinner than said convex portion.

6. A carding machine as defined in claim 1, wherein said slideway is formed of a plastic-coated steel band.

7. A carding machine as defined in claim 1, wherein said concave portions are formed of a plastic-coated steel band.

8. A carding machine as defined in claim 1, wherein said concave portions are arranged coaxially relative to, and being looped about the respective said end sprockets.

9. A carding machine as defined in claim 1, wherein said slideway is a flexible plastic member.

10. A carding machine as defined in claim 1, wherein said support means comprises a support band extending coaxially with one of said end sprockets and is looped around one of said concave portions.

11. A carding machine comprising
(a) a main carding cylinder;
(b) a flexible bend situated laterally of said main carding cylinder; and
(c) a travelling flats assembly situated above said main carding cylinder and having a working path along an upper circumference of said main carding cylinder; said travelling flats assembly including
(1) a first and a second end sprocket positioned at a beginning and at an end, respectively, of said working path;
(2) an endless drive element trained about and supported by said first and second end sprockets;
(3) a slideway positioned on said flexible bend; said slideway having a convex portion following the curvature of said main carding cylinder along said working path and a concave portion adjacent said convex portion at the beginning and at the end, respectively, of said working path; said concave portions following the curvature of said first and second end sprockets, respectively;
(4) support means for holding said concave portions about said first and second end sprockets, respectively;
(5) a plurality of flat bars carried by said endless drive element, each flat bar having a flat bar end supported on said slideway for travel along said working path; and
(6) fastening means for fixedly securing said slideway to said flexible bend at a location of attachment; said location of attachment being situated in a zone of a beginning of said convex portion as viewed in a direction of advance of said flat bars along said working path.

12. A carding machine comprising
(a) a main carding cylinder;
(b) a flexible bend situated laterally of said main carding cylinder; and
(c) a travelling flats assembly situated above said main carding cylinder and having a working path along an upper circumference of said main carding cylinder; said travelling flats assembly including
(1) a first and a second end sprocket positioned at a beginning and at an end, respectively, of said working path;
(2) an endless drive element trained about and supported by said first and second end sprockets;
(3) a slideway positioned on said flexible bend; said slideway having a convex portion following the curvature of said main carding cylinder along said working path and a concave portion adjacent said convex portion at the beginning and at the end, respectively, of said working path; said concave portions following the curvature of said first and second end sprockets, respectively;
(4) support means for holding said concave portions about said first and second end sprockets, respectively;
(5) a plurality of flat bars carried by said endless drive element, each flat bar having a flat bar end supported on said slideway for travel along said working path;
(6) fastening means for fixedly securing said slideway to said flexible bend at a location of attachment; and
(7) support elements pivoted to said slideway and engaging said flexible bend.

13. A carding machine as defined in claim 12, wherein said support elements are arranged coaxially to the respective said end sprockets.

14. A carding machine comprising
(a) a main carding cylinder;
(b) a flexible bend situated laterally of said main carding cylinder; and
(c) a travelling flats assembly situated above said main carding cylinder and having a working path along an upper circumference of said main carding cylinder; said travelling flats assembly including
(1) a first and a second end sprocket positioned at a beginning and at an end, respectively, of said working path;
(2) an endless drive element trained about and supported by said first and second end sprockets;
(3) a slideway positioned on said flexible bend; said slideway having a convex portion following the curvature of said main carding cylinder along said working path and a concave portion adjacent said convex portion at the beginning and at the end, respectively, of said working path; said concave portions following the curvature of said first and second end sprockets, respectively; each said concave portion having a free end;
(4) support means for holding said concave portions about said first and second end sprockets, respectively;
(5) a plurality of flat bars carried by said endless drive element, each flat bar having a flat bar end supported on said slideway for travel along said working path;
(6) fastening means for fixedly securing said slideway to said flexible bend at a location of attachment; and
(7) force-exerting means for exerting a pulling force to the free end of said concave portions.

15. A carding machine as defined in claim 14, wherein said force-exerting means comprises a pivotally supported bellcrank level having one end carrying a weight and having another end attached at least indirectly to said free end.

16. A carding machine as defined in claim 14, wherein said force-exerting means comprises a tension spring.

17. A carding machine as defined in claim 16, wherein said tension spring has a flat spring characteristic.

18. A carding machine comprising (a) a main carding cylinder;

(b) a flexible bend situated laterally of said main carding cylinder; and (c) a travelling flats assembly situated above said main carding cylinder and having a working path along an upper circumference of said main carding cylinder; said travelling flats assembly including (1) a first and a second end sprocket positioned at a beginning and at an end, respectively, of said working path;

(2) an endless drive element trained about and supported by said first and second end sprockets;

(3) a slideway positioned on said flexible bend; said slideway having a convex portion following the curvature of said main carding cylinder along said working path and a concave portion adjacent said convex portion at the beginning and at the end, respectively, of said working path; said concave portions following the curvature of said first and second end sprockets, respectively;

(4) support means for holding said concave portions about said first and second end sprockets, respectively;

(5) a plurality of flat bars carried by said endless drive element, each flat bar having a flat bar end supported on said slideway for travel along said working path;

(6) fastening means for fixedly securing said slideway to said flexible bend at a location of attachment; and (7) a support band being co-extensive with said convex portion of said slideway and engaging an outer face of said convex portion.

19. A carding machine as defined in claim 18, further comprising a deflecting roller engaging said support band.

20. A carding machine as defined in claim 18, wherein said support band has first and second ends; said first end being fixedly supported; further comprising a force-exerting element attached to said second end.

* * * * *